United States Patent [19]

Heneger

[11] Patent Number: 4,928,673

[45] Date of Patent: May 29, 1990

[54] ELECTRIC PASSIVE PEDAL EXERCISER

[76] Inventor: Floyd Heneger, 139 S. 8th, Brighton, Colo. 80601

[21] Appl. No.: 332,046

[22] Filed: Apr. 3, 1989

[51] Int. Cl.[5] ..... A61H 1/02

[52] U.S. Cl. ..... 128/25 R; 272/70; 272/73; 128/25 B

[58] Field of Search ..... 272/69, 70, 73; 128/25 R, 25 B

[56] References Cited

U.S. PATENT DOCUMENTS

| | | | |
|---|---|---|---|
| 2,202,187 | 5/1940 | Chalette | 128/25 R |
| 2,616,416 | 11/1952 | Gillmeier | 128/25 R |
| 3,911,908 | 10/1975 | Duke | 128/25 R |
| 4,402,502 | 9/1983 | Peters | 272/73 |
| 4,572,501 | 2/1986 | Durham et al. | 272/73 |
| 4,587,960 | 5/1985 | Schotten | 128/25 R |
| 4,643,418 | 2/1987 | Bart | 272/69 |
| 4,676,501 | 6/1987 | Hoagland et al. | 272/70 |

*Primary Examiner*—Richard J. Apley
*Assistant Examiner*—Joe H. Cheng
*Attorney, Agent, or Firm*—H. Kenneth Johnston, II

[57] ABSTRACT

An electric passive pedal exerciser comprising a frame having a crank mounted thereon with a gear driven by an electric motor. The device is powered by common household power and the speed of the device is controlled by a rheostat. The frame has attached a tilt switch to stop the device if the device would be tripped. The device allows a paraplegic to provide exercise to his legs without the assistance of another individual.

2 Claims, 2 Drawing Sheets

ELECTRIC PASSIVE PEDAL EXERCISER

BACKGROUND OF THE INVENTION

1. Field of the Invention

The invention relates to an electric passive pedal exerciser for passive leg exercise of the kind being of lightweight construction with a frame providing stability and support for a motor driven crank and pedals by means of a gear drive. The speed of the motor is controlled by a rheostat and the device utilizes common household current. The device has a tilt switch to reduce the possibility of injury of an individual in the event the device is inadvertently tipped over. The device is utilizable by a paraplegic without the requirement of assistance of another individual.

2. Description of the Prior Art.

There are numerous passive pedal devices such as Peters U.S. Pat. No. 4,402,502 which provides passive exercise for a wheelchair confined individual, however the device is large and is not designed to be easily moved and cannot be operated by the confined individual. Durham U.S. Pat. No. 4,572,501 requires the confined person to be able to turn the device with his own upper body strength and is of no value to one requiring an electric wheelchair. Schotten U.S. Pat. No. 4,587,960 is another pedal device but is limited in that it is bulky, not easily transported and generally would require the assistance of another individual to operate it.

The benefits of passive exercise is indisputable and provides needed exercise for paraplegic individuals and also provides much needed exercise for individuals with other non permanent injuries such as fracture.

BRIEF SUMMARY OF THE INVENTION

It is an object of the within invention, to provide an apparatus which will permit paraplegic or other similarly confined patients to exercise their legs without the necessity of another person to aid them. Another aspect of the device is to provide the needed exercise to the legs of individuals who are more limited than those previously described and require the attention of an aid for all or the majority of their activities.

With this in mind, there is provided in accordance with the invention an electric passive pedal exerciser consisting of a lightweight frame having a handle mounted to it, a crank assembly including bearings and rotatable shaft with opposed arm and pedals similar to the crank assembly of that of a bicycle. The crank assembly has a gear firmly attached to the shaft which is driven by a gear attached to the shaft of an electric motor. The gear rotor is selected so that the crank assembly will turn with suffecient speed to provide exercise to the user but will not be so fast as to injure the user or so slow as to be ineffective. The electric motor speed is controlled by a slide rheostat allowing the user to vary the speed of the rotation of the pedals to provide the desired exercise.

Another aspect of the invention is that the rheostat is contained in a control box which can be attached to a wheel chair or merely placed in the individuals lap for controlling the speed and including stopping the exerciser.

Another aspect of the exerciser is the tilt switch which is attached to the frame and contacts the surface below the exerciser and will automatically shut off the exerciser if it gets off balance or tips over. The exerciser must be righted and the reset on the control box must be engaged before the exerciser will again operate.

Still another object of the invention is to provide easy foot placement and attachment on the pedals by the use of adjustable straps, one to hold the arch area and the other to support around the heel of the foot. The straps are of sufficient width to provide comfort to the user.

BRIEF DESCRIPTION OF THE DRAWINGS

The accompanying drawings illustrate the best mode presently contemplated by the inventor for carrying out the invention.

In the drawings.

DESCRIPTION OF THE PREFERRED EMBODIMENT

Figure 2:
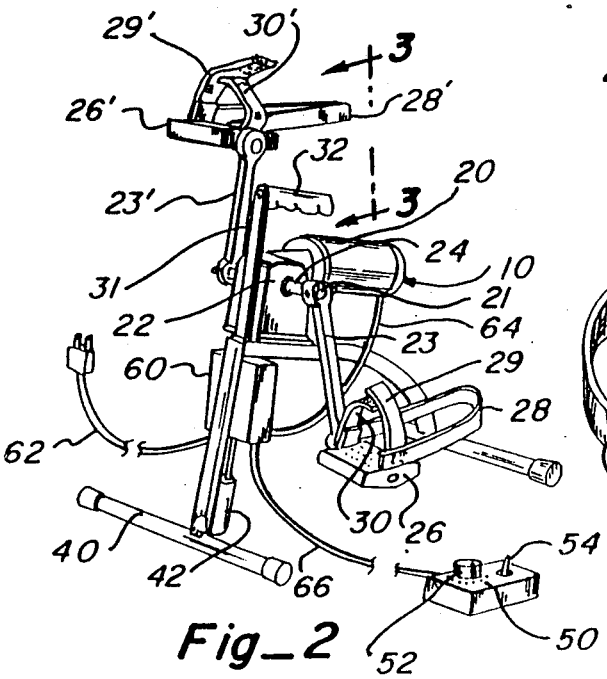
FIG. 2 is a perspective view of the exerciser in oblique front elevation.
Figure 4:
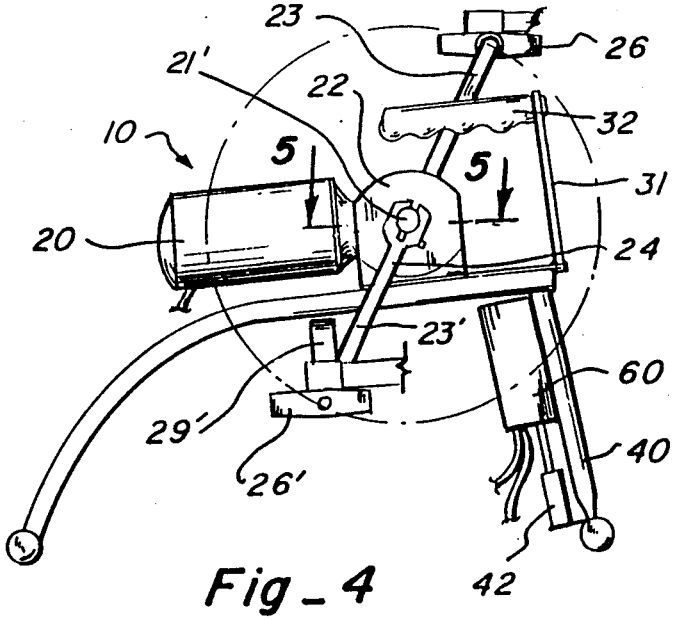
FIG. 4 is a side view of the exerciser.
Figure 5:
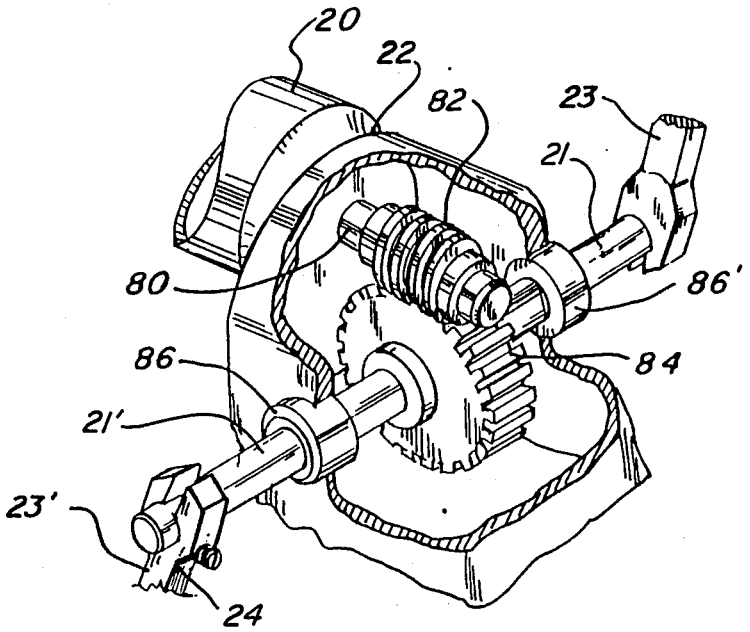
FIG. 5 is a perspective view of the internal portion of crank assembly housing taken along the lines 5—5.

Referring to FIG. 2, the exerciser 10 of the invention includes a frame 40, a crank assembly housing affixed to said frame for supporting and housing crank assembly 24, being rotatably mounted. Electric motor 20 by means of shaft 80 drives worm gear 82 therein turning worm gear 84 affixed to shaft 21, 21' of crank assembly 24 shown FIG. 5 and rotating crank assembly 24. Crank assembly 24 is mounted in crank assembly housing 22 by press fit bearings 86 and 86'. Crank assembly 24 has crank arm 23,23' extending opposite each other and having pedals 26,26' at the outer end portion pivotally mounted thereof as shown in FIGS. 2 and 4.

Figure 3:
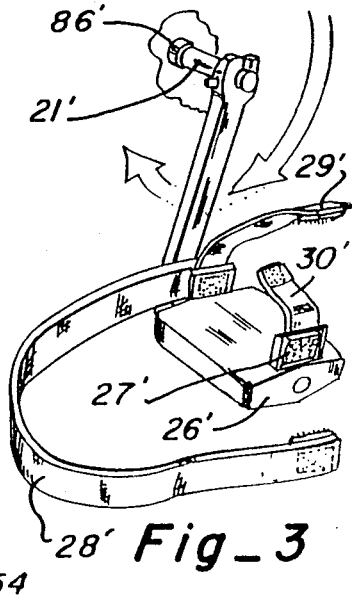
FIG. 3 is an enlarged view of the pedal attachments taken along the line 3—3.

Pedals 26,26' have arch straps 29,29' and arch strap attachments 30,30', heel straps 28,28' and heel strap attachments 27,27' which are made of "Velcro" type material for retaining and individuals foot and are easily adjustable to any size foot as shown in FIGS. 2 and 3.

Exerciser 10 has a tilt switch 42, which is connected to junction box 60, to turn off the power in the event said exerciser 10 would become off balance or tip over.

Exerciser 10 has handle 32 attached to said frame 40 by handle frame 31 and allows the user to pick up exerciser 10 and easily move it about.

Exerciser 10 utilizes regular house current and plugs into a receptacle 2 with power cord 62. Power then goes to junction box 60 and is distributed to electric motor 20 by wy of motor cord 64 and control box cord 66. Further control box 60 has slide rheostat 52 which turns on and varries the speed of the electric motor 20 and crank assembly 24. Control box 50 also has reset switch 54 which must be reset if tilt switch 42 disengages the power.

Figure 1:
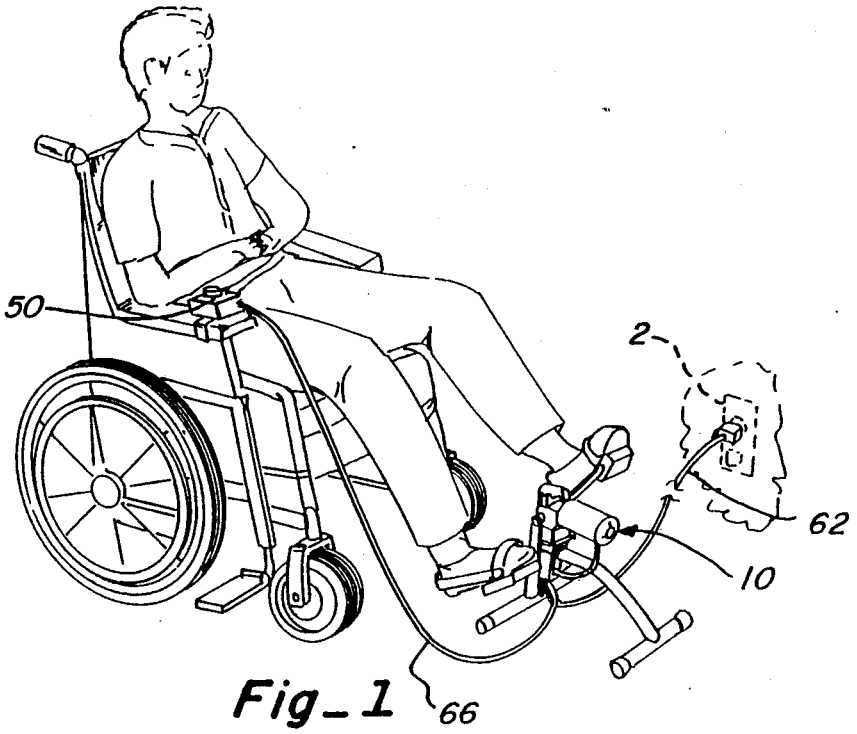
FIG. 1 is a perspective of an exerciser constructed in accordance with the invention, and showing it in use by a wheelchair confined individual.

The exerciser 10 is adapted to accomodate wheelchair confined individuals are shown in FIG. 1.

It is understood that the above foot restraint can be readily replaced with various foot enclosures and not diviate from the spirit of the invention.

It will be apparent to one skilled in the art that various changes and modifications in addition to those already suggested can be made in the device without departing from the true scope and spirit of the present invention. For example, the foot restraint may be of a single strap and utilize buckles. Further the frame assembly may be varied as well as the crank assembly and worm driven may utilize a variety of drive gear means. It is thus apparent to one skilled in the art that many modifications can be made in the instant invention without deviating from the spirit of the invention.

What I claim:

1. A light weight portable electric passive exercise device comprising:

a light weight portable frame means having a handle for ease of use and portability by a paraplegic;

a crank assembly housing mounted on said frame means;

a crank assembly means rotatably mounted in said crank assembly housing;

a motor mounted on said crank assembly housing and a gear means drivably connected said motor to said crank assembly means for rotatably driving said crank assembly;

said motor electrically connected with a rheostat for controlling the speed of said crank assembly means;

a tilt switch means electrically interconnected with said motor to automatically disengage power if said exercise device becomes unbalanced;

and a reset switch electrically interconnected with said tilt switch means and said motor for resetting said exercise device to operational status after said tilt switch means has been activated;

a pedal means pivotally mounted at the outer ends of said crank assembly means having a foot restraint means for holding an individual's foot in place while using said exercise device.

2. A device as claimed in claim 1 wherein:

said frame means is a light weight tubular frame adapted to set on an appropriate surface.

* * * * *